US006299709B1

(12) United States Patent
Lundström

(10) Patent No.: US 6,299,709 B1
(45) Date of Patent: Oct. 9, 2001

(54) BOW-FORMED BUMPER, A METHOD OF FORMING A BOW-FORMED BUMPER, AND A METHOD OF HYDROFORMING A BLANK THEREFOR

(75) Inventor: Erland Lundström, Gammelstad (SE)

(73) Assignee: SSAB Hardtech AB, Lulea (SE)

( * ) Notice: Subject to any disclaimer, the term of this patent is extended or adjusted under 35 U.S.C. 154(b) by 0 days.

(21) Appl. No.: 09/575,019

(22) Filed: May 19, 2000

Related U.S. Application Data

(63) Continuation-in-part of application No. PCT/SE98/02095, filed on Nov. 19, 1998.

(30) Foreign Application Priority Data

Nov. 20, 1997 (SE) ..... 9704248

(51) Int. Cl.[7] ..... C21D 8/00; C21D 8/10

(52) U.S. Cl. ..... 148/648; 148/320; 72/54; 72/60; 72/61

(58) Field of Search ..... 148/648, 655, 148/320; 72/58, 60, 62, 61, 54

(56) References Cited

FOREIGN PATENT DOCUMENTS

| | | |
|---|---|---|
| 1490535 | 11/1977 | (GB) . |
| 64771 | 2/1927 | (SE) . |
| 435527 | 10/1984 | (SE) . |
| 508902 | 11/1998 | (SE) . |

*Primary Examiner*—Deborah Yee
(74) *Attorney, Agent, or Firm*—Nils H. Ljungman & Associates

(57) ABSTRACT

A blank with a closed profile is made of hardenable sheet steel and is hydroformed when hot. The tool is cooled and the blank is heated to a hardening temperature and formed so fast that it will not have time to harden before it contacts the tool and becomes rapidly cooled by the tool and by the liquid fluid so that it hardens. In this simple way, a product of high strength steel can be achieved which has a closed profile and complicated form. The product can be, for example, a bow-formed bumper.

11 Claims, No Drawings

BOW-FORMED BUMPER, A METHOD OF FORMING A BOW-FORMED BUMPER, AND A METHOD OF HYDROFORMING A BLANK THEREFOR

CONTINUING APPLICATION DATA

This application is a Continuation-In-Part application of International Patent Application No. PCT/SE98/02095, filed on Nov. 19, 1998, which claims priority from Swedish Patent Application No. 9704248-5, filed on Nov. 20, 1997. International Application No. PCT/SE98/02095 was pending as of the filing date of the above-cited application. The United States was an elected state in International Application No. PCT/SE98/02095.

BACKGROUND OF THE INVENTION

1. Field of the Invention

The present invention relates to a bow-formed bumper for a vehicle and a method of forming the bow-formed bumper. The method of forming the bow-formed bumper may comprise hydroforming the bow-formed bumper.

The present invention further relates to a method of hydroforming a blank with a closed profile in a partible tool by supplying a pressure fluid into the blank.

2. Background Information

Hydroforming is a well-known forming process that uses pressurized fluid, such as water or oil, or, less commonly, pressurized gas to deform a structural member into a desired shape. Generally in this process, the structural member is placed inside a die, usually made of two die sections that are placed about the structural member. The inside of the die determines the shape of the product to be formed. The structural member is then filled with the pressurized fluid. The pressure of the fluid is such that the structural member is outwardly deformed into conformance with the shape of the interior of the die to create the desired shape. This is especially useful in creating substantially tubular or box-shaped beams or other structural pieces for use in vehicles.

This well known technique is limited substantially to steels with a good formability. Steel with a high yield strength has too limited elongation and can therefore only be used when the forming is light. It is, however, conventional to hydroform in several steps and to anneal between the forming steps when greater forming is desired than the steel itself permits.

OBJECT OF THE INVENTION

It is an object of the present invention to receive a high strength product in a fast and simple way.

A further object of the present invention is to create a bow-formed bumper for a vehicle and to develop a method of forming the bow-formed bumper.

SUMMARY OF THE INVENTION

According to the present invention, the tool is maintained cooled, a blank that is hardenable is heated to a hardening temperature, placed in the tool and pressurized so that it is formed into contact with the tool, and kept in contact with the tool and the pressure fluid long enough to permit it to harden before it is removed from the tool, the forming being so fast that the blank will not have time to harden by the contact with the pressure fluid.

In other words, according to one possible embodiment of the present invention, a tool or die apparatus can be maintained at a substantially cool temperature. A hardenable blank or structural piece can be heated to a hardening temperature and then placed in the tool. The blank can then be pressurized with a pressurized liquid so that it is deformed by contact with the tool. The blank can be kept in contact with the tool and the pressure fluid long enough to permit it to harden before it is removed from the tool. The forming of the blank can be so fast that the blank will not have time to harden by contact with the pressure fluid.

DESCRIPTION OF THE PREFERRED EMBODIMENTS

The hardenable blank can be made of boron alloyed sheet steel. The pressure fluid can be a gas, but it is preferably a liquid, for example water. It can also be an oil. It can be an advantage to have the liquid pre-heated since its initial cooling effect will then be reduced. In this way, the liquid can be used to control the structure of the product. The liquid can be pre-heated to a temperature above the martensite forming temperature Ms("s" is subscript) and the resulting structure will be mainly bainite. The liquid can also be held at a lower temperature so that the structure will be a mixture of bainite and martensite. At still a lower temperature of the liquid, there will be a mixture of bainite and martensite and the martensite will be annealed during the cooling. The suitable temperature varies with the analysis of the steel and with the desired properties of the product. By simple testing, the temperatures of the tool and fluid that result in a product with desired properties can be found easily. A temperature of the pressure liquid below about 200° C. can be expected to have only a minor effect on the structure when the thickness of the sheet steel is 1–1.5 mm, but it will reduce the cooling during the forming as compared with a liquid at room temperature.

The temperature of the pressure liquid can thus be from room temperature up to about 500° C., but a temperature of 50°–200° C. can often be advantageous if a mainly martensitic structure is desired.

Since the hardening reduces the formability, the fluid flow should be so large a complete forming or almost complete forming takes place before the blank hardens. This means that the forming should usually take place in preferably less than 2 seconds. The air in the blank can be evacuated before the blank is pressurized, but the air could also remain during the forming. If the air is to remain, one should see to it that the air is left in places where the reduced cooling will not be harmful. The two tool parts (the passive tool) can be cooled by a liquid that circulates in channels in the tools.

With the described method, bumper beams with closed profiles, as well as pillars for doors and other parts for a vehicle, can be made in accordance with the present invention. Suitably, tube-formed blanks can be used which are made of welded sheet steel of a hardenable steel quality, for example boron steel. The thickness of the sheet steel can be freely selected so that the finished product will have desired thickness of for example 1–4 mm. A blank can consist of several steel qualities and it may have different sheet thickness in different parts. In this way, a product with a closed profile and complicated form may be formed in high strength steel and it will have narrow tolerances in form and size.

The time it takes to perform the method of hydroforming a blank with a closed profile in a partible tool by supplying a pressure fluid into the blank, wherein the tool is maintained at a substantially cool temperature, and a blank that is hardenable is heated to a hardening temperature and placed in the tool and pressurized so that it is formed into contact with the tool and kept in contact with the tool and the pressure fluid long enough to permit it to harden before it is removed from the tool, which forming is so fast that the blank will not have time to harden by the contact with the pressure fluid, can vary according to several factors. The time will depend on the characteristics of the blank to be formed, such as the length, width, and thickness. The type of metal that the blank is made of and the corresponding hardening temperature of the metal will also affect the time needed. The initial shape of the blank and the ultimate, desired shape of the blank are additional factors that affect the amount of time needed to hydroform a blank. All of these factors can be measured, determined and accounted for without undue experimentation by someone skilled in the art to which the present invention most nearly pertains.

A blank, in at least one embodiment of the present invention, can be a hollow tube or pipe. The blank can have a closed profile, which can mean that the blank surrounds the hollow space in the tube or pipe.

In at least one other embodiment of the present invention, the process of hydroforming a blank is done so quickly that the properties or characteristics of the metal that comprises the blank are not substantially altered or affected.

One feature of the invention resides broadly in the method of hydroforming a blank with closed profile in a partible tool by supplying a pressure fluid into to blank, characterized in that the tool is maintained cooled, a blank that is hardenable is heated to a hardening temperature, placed in the tool and pressurized so that it is formed into contact with the tool, and kept in contact with the tool and the pressure fluid long enough to permit it to harden before it is removed from the tool, the forming being so fast that the blank will not have time to harden by the contact with the pressure fluid.

Another feature of the invention resides broadly in the method characterized in that the pressure fluid is a liquid.

Yet another feature of the invention resides broadly in the method characterized in that the flow of liquid is large enough to permit for the forming to be carried out in less than 2 seconds.

Still another feature of the invention resides broadly in the method characterized in that the liquid is preheated to a temperature that results in the desired hardening structure.

The components disclosed in the various publications, disclosed or incorporated by reference herein, may be used in the embodiments of the present invention, as well as, equivalents thereof.

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The following U.S. patents and/or patent applications are hereby incorporated by reference as if set forth in their entirety herein as follows: U.S. Pat. No. 5,600,931, issued on Feb. 11, 1997 to inventor Jonsson; U.S. patent application Ser. No. 09/164,848 entitled "Structural Beam for Supporting and Reinforcing a Structure," filed on Oct. 1, 1998, having inventors Hortlund and Sandberg; U.S. patent application Ser. No. 09/498,170 entitled "Method of Producing a Sheet Steel Product Such as a Motor Vehicle Bumper Beam in a Progressive Die System," filed on Feb. 4, 2000, having inventor Jonsson; and U.S. patent application Ser. No. 09/553,678 entitled "Beam for a Vehicle," filed on Apr. 21, 2000, having inventor Jonsson.

The following patents, patent applications, or patent publications, which were cited in the PCT Search Report dated Mar. 23, 1999, and/or cited elsewhere are hereby incorporated by reference as if set forth in their entirety herein as follows: SE 64771 C having inventors E. Asberger et al., dated Feb. 22, 1927; SE 435527 B having as an Assignee Plannja AB, dated Oct. 1, 1984; and SE 508902 C2 having as an Assignee Accra Teknik AB, dated Nov. 11, 1998.

The corresponding foreign and international patent publication applications, namely, Sweden Patent Application No. 9704248-5, filed on Nov. 20, 1997, having inventor Erland Lundstrom, and Laid-Open Swedish Patent No. 9704248-5 and Published Swedish Patent No. 9704249-5 and International Application No. SE98/02095, filed on Nov. 19, 1998, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clauses, if any, are intended to cover the structures described herein as performing the recited function and not only structural equivalents but also equivalent structures.

The invention as described hereinabove in the context of the preferred embodiments is not to be taken as limited to all of the provided details thereof, since modifications and variations thereof may be made without departing from the spirit and scope of the invention.

What is claimed is:

1. A bow-formed bumper with a closed profile, which bow-formed bumper is formed in a partible tool by supplying a pressure fluid into a blank, characterized in that the tool is maintained cooled, a blank that is hardenable is heated to a hardening temperature, placed in the tool and pressurized so that it is formed into contact with the tool, and kept in contact with the tool and the pressure fluid long enough to permit it to harden before it is removed from the tool, the forming being so fast that the blank will not have time to harden by the contact with the pressure fluid.

2. A method of forming a bow-formed bumper with a closed profile in a partible tool by supplying a pressure fluid into a blank, characterized in that the tool is maintained cooled, a blank that is hardenable is heated to a hardening temperature, placed in the tool and pressurized so that it is formed into contact with the tool, and kept in contact with the tool and the pressure fluid long enough to permit it to harden before it is removed from the tool, the forming being so fast that the blank will not have time to harden by the contact with the pressure fluid.

3. The method according to claim 2, characterized in that the pressure fluid is a liquid.

4. The method according to claim 3, characterized in that the flow of liquid is large enough to permit for the forming to be carried out in less than 2 seconds.

5. The method according to claim 4, characterized in that the liquid is preheated to a temperature that results in the desired hardening structure.

6. A method of hydroforming a blank with closed profile in a partible tool by supplying a pressure fluid into a blank, characterized in that the tool is maintained cooled, a blank that is hardenable is heated to a hardening temperature, placed in the tool and pressurized so that it is formed into contact with the tool, and kept in contact with the tool and the pressure fluid long enough to permit it to harden before it is removed from the tool, the forming being so fast that the blank will not have time to harden by the contact with the pressure fluid.

7. The method according to claim 6, characterized in that the pressure fluid is a liquid.

8. The method according to claim 7, characterized in that the flow of liquid is large enough to permit for the forming to be carried out in less than 2 seconds.

9. The method according to claim 6, characterized in that the liquid is preheated to a temperature that results in the desired hardening structure.

10. The method according to claim 7, characterized in that the liquid is preheated to a temperature that results in the desired hardening structure.

11. The method according to claim 8, characterized in that the liquid is preheated to a temperature that results in the desired hardening structure.

* * * * *